US012709314B2

(12) United States Patent
Beach et al.

(10) Patent No.: US 12,709,314 B2
(45) Date of Patent: Aug. 18, 2026

(54) VEHICLE POSITIONING SYSTEM

(71) Applicant: Hitachi Rail GTS Canada Inc., Toronto (CA)

(72) Inventors: David Beach, Toronto (CA); Alon Green, Toronto (CA)

(73) Assignee: Hitachi Rail GTS Canada Inc., Toronto (CA)

( * ) Notice: Subject to any disclaimer, the term of this patent is extended or adjusted under 35 U.S.C. 154(b) by 1152 days.

(21) Appl. No.: 17/649,014

(22) Filed: Jan. 26, 2022

(65) Prior Publication Data

US 2022/0234634 A1 Jul. 28, 2022

Related U.S. Application Data

(60) Provisional application No. 63/141,727, filed on Jan. 26, 2021.

(51) Int. Cl.

| | |
|---|---|
| ***B61L 25/02*** | (2006.01) |
| ***B61L 27/20*** | (2022.01) |
| ***B61L 27/57*** | (2022.01) |

(52) U.S. Cl.

CPC ..... *B61L 25/026* (2013.01); *B61L 25/021* (2013.01); *B61L 27/20* (2022.01); *B61L 27/57* (2022.01); *B61L 2027/204* (2022.01)

(58) Field of Classification Search

CPC ..... B61L 25/026; B61L 25/021; B61L 27/20; B61L 27/57; B61L 2027/204; B61L 15/0063; B61L 25/025; G01C 22/00

See application file for complete search history.

(56) References Cited

U.S. PATENT DOCUMENTS

| | | | |
|---|---|---|---|
| 9,221,481 | B2 | 12/2015 | Desbordes et al. |
| 9,482,538 | B1 | 11/2016 | Pathangay |

(Continued)

FOREIGN PATENT DOCUMENTS

| | | | |
|---|---|---|---|
| DE | 10 2018 115 978 | B3 | 12/2018 |
| EP | 3589527 | A1 | 1/2020 |

(Continued)

OTHER PUBLICATIONS

The partial supplementary European search report (R. 164 EPC) issued by the European Patent Office on Feb. 5, 2025, which corresponds to European Patent Application No. 22745470.9-1009 and is related to U.S. Appl. No. 17/649,014, all pages.

(Continued)

*Primary Examiner* — Zachary L Kuhfuss

(74) *Attorney, Agent, or Firm* — Studebaker Brackett PLLC

(57) ABSTRACT

A vehicle positioning system includes processing circuitry in communication with the vehicle. The system further includes a memory connected to the processing circuitry, where the memory is configured to store executable instructions that, when executed by the processing circuitry, facilitate performance of operations. The operations include to receive vehicle-speed data from a first set of sensors operably coupled to the vehicle. The operations further include to predict a vehicle location based on the vehicle-speed data. The operations further include to receive inertial data from a second set of sensors operably coupled to the vehicle, and update the predicted vehicle location based upon the inertial data.

20 Claims, 5 Drawing Sheets

(56) References Cited

U.S. PATENT DOCUMENTS

| | | | | |
|---|---|---|---|---|
| 10,309,778 | B2 | 6/2019 | Zhang et al. | |
| 10,606,274 | B2 | 3/2020 | Yalla et al. | |
| 2015/0239482 | A1* | 8/2015 | Green | B61L 15/0063 246/122 R |
| 2018/0120843 | A1 | 5/2018 | Berntorp et al. | |
| 2019/0278273 | A1 | 9/2019 | Behrendt et al. | |
| 2019/0347820 | A1 | 11/2019 | Golinsky et al. | |
| 2020/0053292 | A1 | 2/2020 | Janjic et al. | |
| 2020/0070859 | A1 | 3/2020 | Green et al. | |
| 2020/0181879 | A1 | 6/2020 | Halder et al. | |
| 2020/0331465 | A1 | 10/2020 | Herman et al. | |
| 2020/0378766 | A1 | 12/2020 | Omari et al. | |
| 2020/0379484 | A1 | 12/2020 | Omari et al. | |
| 2020/0391780 | A1 | 12/2020 | Carter et al. | |
| 2021/0094595 | A1* | 4/2021 | Kälberer | B61L 25/025 |

FOREIGN PATENT DOCUMENTS

| | | | |
|---|---|---|---|
| EP | 3594086 | A2 | 1/2020 |
| WO | 2012158906 | A1 | 11/2012 |

OTHER PUBLICATIONS

International Search Report and Written Opinion issued in corresponding International Application No. PCT/IB2022/050691, dated Apr. 8, 2022, pp. 1-8, Canadian Intellectual Property Office, Quebec, Canada.

An Examination Report mailed by The Canadian Intellectual Property Office on Dec. 11, 2024, which corresponds to Canadian Patent Application 3,204,228 and is related to U.S. Appl. No. 17/649,014, all pages.

Florian Tschopp, Thomas Schneider, Andrew W. Palmer, Navid Nourani-Vatani, Cesar Cadena, Roland Siegwart, Juan Nieto, Experimental comparison of visual-aided odometry methods for rail vehicles, Feb. 4, 2019.

Milad Ramezani, Kourosh Khoshelham, Laurent Kneip, Omnidirectional visual-inertial odometry using multi-state constraint Kalman filter, Sep. 24, 2017.

Cagri Kilic, Jason N. Gross, Nicholas Ohi, Ryan Watson, Jared Strader, Thomas Swiger, Scott Harper, Yu Gu, Improved Planetary Rover Inertial Navigation and Wheel Odometry Performance through Periodic Use of Zero-Type Constraints, Sep. 23, 2019.

Changhao Chen, Chris Xiaoxuan Lu, Bing Wang, Niki Trigoni, Andrew Markham, DynaNet: Neural Kalman Dynamical Model for Motion Estimation and Prediction, Aug. 11, 2019.

The extended European search report issued by the European Patent Office on May 9, 2025, which corresponds to European Patent Application No. 22745470.9-1009 and is related to U.S. Appl. No. 17/649,014, all pages.

* cited by examiner

VEHICLE POSITIONING SYSTEM

CROSS-REFERENCE TO RELATED APPLICATIONS

This disclosure claims the priority of U.S. Provisional Application No. 63/141,727, filed Jan. 26, 2021, which is incorporated herein by reference in its entirety.

BACKGROUND

Positioning and speed of a rail vehicle are determined by a system comprised of a checked-redundant vehicle onboard controller (VOBC) operationally connected to a set of sensors. The sensors consist of a radio frequency identification (RFID) tag reader, a tachometer/speed sensor, a camera, an event camera, a LIDAR, UWB technology, a radar, and accelerometers, and RFID tags installed along the guideway.

Systems that use unconstrained integration of inertial measurements (e.g., a free-space integration of inertial measurement units (IMU) or inertial sensors) in order to perform positioning or restrict vehicle motion along a track, guideway or path. This restriction; however, introduces error and/or uncertainty in the vehicle position.

BRIEF DESCRIPTION OF THE DRAWINGS

Aspects of the present disclosure are best understood from the following detailed description when read with the accompanying FIGS. It is noted that, in accordance with the standard practice in the industry, various features are not drawn to scale. In fact, the dimensions of the various features be arbitrarily increased or reduced for clarity of discussion.

DETAILED DESCRIPTION

Figure 1:
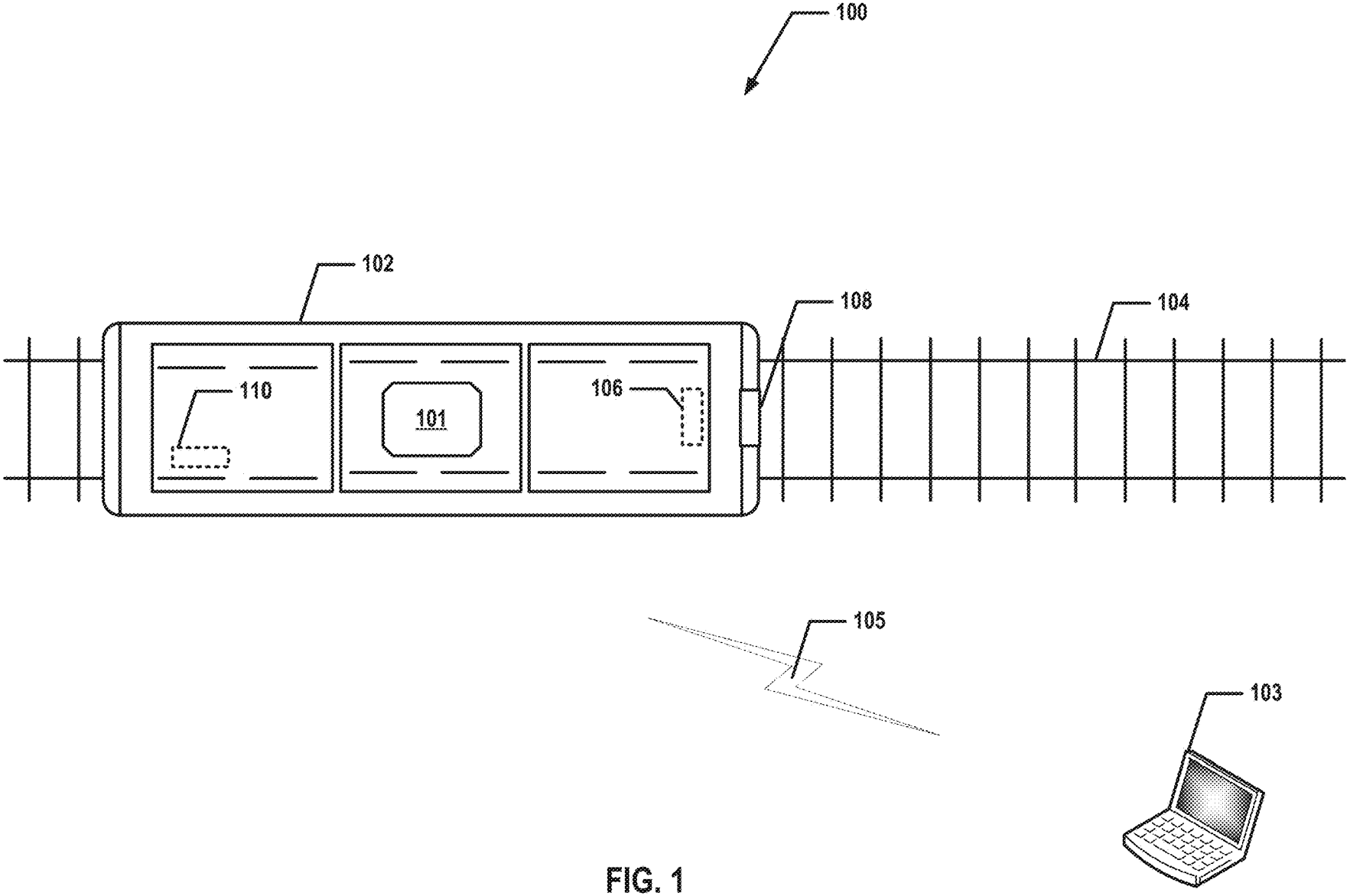
FIG. 1 is a top-level diagram of a vehicle positioning system (VPS), in accordance with some embodiments.

The following disclosure discloses many different embodiments, or examples, for implementing different features of the disclosed subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows include embodiments in that the first and second features are formed in direct contact, and further include embodiments in that additional features are formed between the first and second features, such that the first and second features are not in direct contact. In addition, the present disclosure repeats reference numerals and/or letters in the various examples. This repetition is for the purpose of simplicity and clarity and does not in itself dictate a relationship between the various embodiments and/or configurations discussed.

Further, spatially relative terms, such as beneath, below, lower, above, upper and the like, are used herein for ease of description to describe one element or feature's relationship to another element(s) or feature(s) as illustrated in the FIGS. The spatially relative terms are intended to encompass different orientations of the device in use or operation in addition to the orientation depicted in the FIGS. The apparatus is otherwise oriented (e.g., rotated 90 degrees or at other orientations) and the spatially relative descriptors used herein likewise be interpreted accordingly.

In some embodiments, the term 'along-track' is used to refer to the vehicle state (e.g., position, velocity (speed and direction), and acceleration (change in speed over time)). A vehicle along-track (e.g., on a rail or guideway) or in a constrained state (such as a vehicle on a predetermined route) refers to a vehicle with less than nine degrees of freedom (9DOF). In some embodiments, the vehicle constrained state includes a vehicle along-track position (e.g., vehicle position), the vehicle along-track velocity (e.g., vehicle speed and direction), and the vehicle along-track acceleration (e.g., vehicle change in velocity over time). Additionally or alternatively, the vehicle constrained state is defined in conjunction with a three-dimensional (3D) constraining path where vehicle motion is restricted (e.g., the vehicle is not free to move in any direction and instead is restricted, such as along a railway, track, guideway, or predetermined route on a roadway). In some embodiments, this state has three degrees-of-freedom (3DOF).

In some embodiments, a vehicle in an unconstrained state (e.g., a free-space state) refers to a nine degrees-of-freedom (9DOF) vehicle state. In some embodiments, within the 9DOF is the 3DOF position, orientation (e.g., yaw, pitch, and roll) and the velocity. In some embodiments, the vehicle constrained state has 3DOF. Therefore, the vehicle constrained state is referenced without an associated constraining path (e.g., the position, orientation, and velocity are known without knowing the location or mapping of the constrained path).

FIG. 1 is a top-level diagram of a vehicle positioning system (VPS), in accordance with some embodiments.

A vehicle positioning system (VPS) 100 includes a vehicle 102 in communication with a CBTC 103. A wireless communication path 105 connects a vehicle onboard controller (VOBC) 101 and CBTC 103. Vehicle 102 is on a constrained path 104, such as a rail or a guideway. In some embodiments, vehicle 102 is an autonomous vehicle. In some embodiments, vehicle 102 is another vehicle type that is configured to use a constrained path or constrained motion, such as a shuttle, a personal transport, a guided vehicle, a monorail, or an automation slide. In some embodiments, vehicle 102 is another type of ground vehicle, such as road vehicle (e.g., car or truck) and off-road vehicles (e.g., all-terrain vehicles) that have a specific/known path. Vehicle 102 includes a speed sensor 106, an inertial measurement unit (IMU) 108, and an optional vision or scene sensor (such as a radar, LIDAR, or camera) 110.

VPS 100 includes VOBC 101 that is operably connected to CBTC 103 that operates an autonomous train, such as vehicle 102 through wireless communication 105. VPS 100, implements a two-operation process to estimate a vehicle constrained state. A current vehicle constrained state is predicted (e.g., using a first subset of available sensor measurements providing speed data) and then the predicted vehicle constrained state is corrected (e.g., using a second subset of available sensor measurements providing inertial data). The two operations are referred to as a prediction operation and correction operation. In some embodiments, VPS 100 combines sensor data and processes the sensor data to arrive at a high-integrity estimation of the vehicle constrained state.

In some embodiments, CBTC system 103 is a railway signaling system that makes use of telecommunications between the train (such as vehicle 102) and track equipment for traffic management and infrastructure control. CBTC system 103 is configured to use a train constrained state that is more accurate than traditional signaling systems. This results in an efficient and safe way to manage railway traffic satisfying a Safety Integrity Level (SIL) 4. For a system to be rated as Safety Integrity Level (SIL) 4, the system is required to have demonstrable on-demand reliability, and techniques and measurements to detect and react to failures that may compromise the system's safety properties. SIL 4 is based on International Electrotechnical Commission's (IEC) standard IEC 61508 and EN standards 50126 and 50129. SIL 4 requires the probability of failure per hour to range from $10^{-8}$ to $10^{-9}$. Safety systems that are not required to meet a safety integrity level standard are referred to as SIL 0.

In some embodiments, CBTC system 103 is a continuous, automatic train control system utilizing high-resolution train location determination, independent from track circuits, continuous, high-capacity, bidirectional train-to-wayside data communications, and trainborne and wayside processors capable of implementing automatic train protection (ATP) functions, as well as optional automatic train operation (ATO) and automatic train supervision (ATS) functions, as defined in the IEEE 1474 standard, herein incorporated by reference in its entirety.

In other approaches, rail vehicle localization on a guideway is based on inductive loops or radio frequency identification (RFID) transponder tags.

With inductive loops, a message with the loop ID is transmitted over each loop with a different ID per loop. When the vehicle crosses the boundary between two adjacent loops, the vehicle's location and direction of travel on the guideway is initialized. Inside each loop there are cross overs in which the phase of the transmitted signal is flipped. The cross overs are spread every 25 m. Therefore, upon cross over detection (e.g., phase flip) the vehicle's location on the guideway is updated by 25 m in the direction the vehicle is moving. Between crossovers, a tachometer is used for dead reckoning positioning. When the vehicle crosses over to a new loop, the vehicle position on the guideway is re-localized and the direction of travel is updated.

With RFID transponder tags, each tag has a unique ID which corresponds to a specific location on the guideway. The vehicle's position on the guideway is initialized upon the detection of the first tag. However, at this point the direction of travel is still unknown. Upon the detection of the second tag, the direction of travel is established. Between tags, a tachometer is used for dead reckoning position. When the next tag is detected, the vehicle position on the guideway is re-localized.

In other CBTC approaches, a one-dimensional (1D) path constraint is augmented by rough grade information, and this requires frequent position updates (e.g., via a transponder) to reduce positional uncertainty. This CBTC approach is not configured to use information about path curvature and/or grade changes to correct a vehicle state estimate. In contrast, embodiments of the present disclosure are configured to use odometry-driven positioning that is configured to use a 3D path constraint so information about grade changes and/or track curvature is usable to correct the vehicle state estimate.

In other CBTC approaches, a vehicle state correction based on path constraint is not performed. Thus, the output is an estimate of the worst-case positional uncertainty based strictly on uncertainty of displacement integration. Thus, uncertainty increases rapidly, requiring frequent positional updates (e.g., via transponders or loops) to remove accumulated positional uncertainty, even when high-performance sensors are used to estimate position (e.g., tachometers). In contrast, embodiments of the present disclosure allow for longer vehicle running times before positional uncertainty occurs. Longer vehicle running times leads to higher system availability, less installation effort during the system deployment phase (e.g., as less landmarks need to be installed) and lower life cycle cost (e.g., as less effort is needed to maintain the landmarks).

In other CBTC approaches, a tachometer is used for positioning and the CBTC does not make use of additional information available in geometry of a path constraint. Further, other CBTC approaches are able to dead-reckon for hundreds of meters or hundreds of seconds before a measurement from another landmark or speed sensor is required. Otherwise, positional uncertainty will exceed a threshold (e.g., ~20 m). The dead-reckoning performance affects the necessary spacing of landmarks, since exceeding the positional error threshold causes the system to become unavailable. In contrast, embodiments of the present disclosure are configured for improved accuracy and dead-reckoning performance.

In some embodiments, vehicle 102 is a machine that transports people and/or cargo. In some embodiments, vehicle 102 includes wagons, bicycles, motor vehicles (motorcycles, cars, trucks, and buses), railed vehicles (trains, trams), watercraft (ships, boats), amphibious vehicles (screw-propelled vehicle, hovercraft), aircraft (airplanes, helicopters) and spacecraft. Land vehicles are classified broadly by what is used to apply steering and drive forces against the ground: wheeled, tracked, railed or skied, such as is detailed in ISO 3833-1977 standard. Vehicle 102 is restricted to a constrained path, such as constrained path 104. In some embodiments, vehicle 102 is an autonomous vehicle. Autonomous vehicles use mechatronics, artificial intelligence, and/or multi-agent systems to assist a vehicle's operator.

Constrained path 104 is a track on a railway or railroad, further known as a permanent way (e.g., a constrained path). Constrained path 104 is the structure consisting of the rails, fasteners, railroad ties and ballast (or slab track), plus the underlying subgrade. The constrained path enables trains to move by providing a dependable surface for their wheels to roll upon. For clarity, constrained paths are referred to as railway tracks, railroad track or a guideway. However, constrained paths are not restricted to railways and in some embodiments, constrained paths further include any autonomous vehicle that is limited to a predetermined or preprogramed route (e.g., self-driving car or truck moving along an inputted or predetermined route).

In some embodiments, speed sensor 106 is a sensor used to detect the speed of vehicle 102 along constrained path 104. In some embodiments, speed sensor 106 is a wheel speed sensor (e.g., a tachometer), a speedometer, a LIDAR, a ground speed radar, a Doppler radar, or a laser surface velocimeter. In some embodiments, speed sensor 106 senses the rate of change of a vehicle's position with respect to a frame of reference and a difference of time. Velocity is a physical vector quantity that includes both magnitude and direction. If there is a change in speed, then the object has a changing velocity vector and is said to be undergoing an acceleration/deceleration.

In some embodiments, IMU 108 is an electronic device that measures and reports a body's specific force, angular rate, and sometimes the orientation of the body, using a combination of accelerometers and gyroscopes. In some embodiments, IMU 108 includes one or more magnetometers.

In some embodiments, vision sensor 110 is a radar, a LIDAR or a camera used for determining landmark measurements. In some embodiments, CBTC 103 or VOBC 101 are configured with a database storing a known position of many landmarks along a path constraint. A vision sensor 110 determines a distance and bearing to a landmark having a known position and then determines a position of vehicle 102. In some embodiments, this bearing and distance to the known landmark is used by CBTC 103 or VOBC 101 to calculate a position of the vehicle.

In some embodiments, a system including one or more computers are configured to perform particular operations or actions by virtue of having software, firmware, hardware, or a combination of them installed on the system that in operation causes or cause the system to perform the actions. One or more computer programs are configured to perform particular operations or actions by virtue of including instructions that, when executed by data processing circuitry, cause the apparatus to perform the actions. In some embodiments, VPS 100 includes processing circuitry, e.g., processing circuitry 502 (FIG. 5), and a memory, e.g., memory 504 (FIG. 5), connected to the processing circuitry, where the memory is configured to store executable instructions, e.g., executable instructions 506 (FIG. 5), such as methods 200, 300, and 400, of FIGS. 2, 3, and 4. When executed by processing circuitry 502, executable instructions 506 facilitate performance of operations that include: receiving vehicle speed data from a first set of sensors 106 operably coupled to a vehicle 102; predicting a vehicle location based on the vehicle-speed data; receiving inertial data from a second set of sensors 108 operably coupled to vehicle 102; and updating the predicted vehicle location based upon the inertial data.

Figure 2:
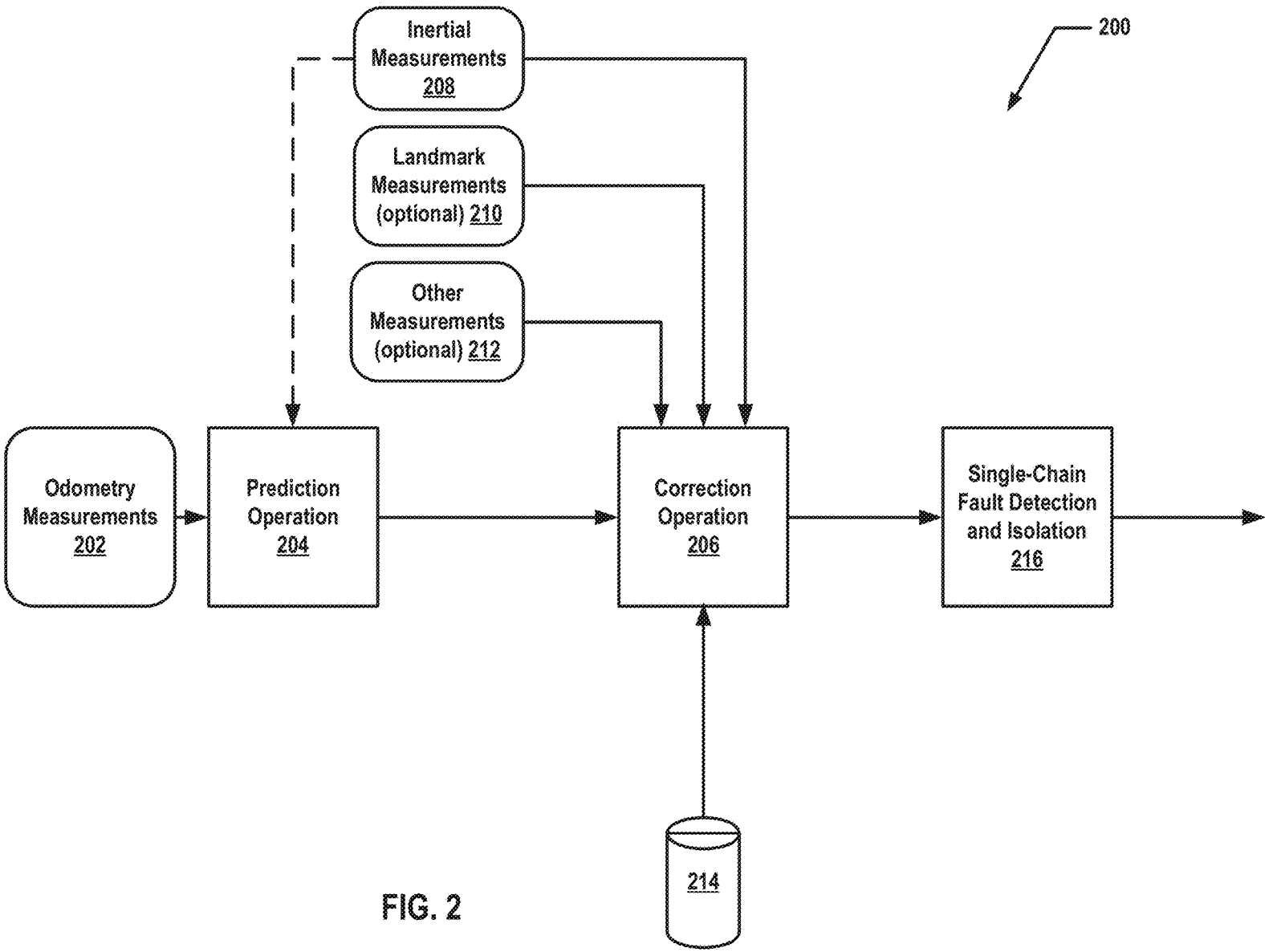
FIG. 2 is a high-level process flow diagram of an odometry-driven positioning (ODP) method, in accordance with some embodiments.

FIG. 2 is a high-level process flow diagram of an odometry-driven positioning (ODP) method 200, in accordance with some embodiments.

In some embodiments, ODP method 200 is a subsystem of VPS 100 and is implemented to determine a constrained vehicle state for vehicle 102. ODP method 200 is configured to accurately predict positioning, motion, and velocity of a vehicle in a constrained state. In some embodiments, ODP method 200 is used to determine vehicle positioning for vehicle 102 of VPS 100. The sequence in which the operations of ODP method 200 are depicted in FIG. 2 is for illustration only; the operations of ODP method 200 are capable of being executed in sequences that differ from that depicted in FIG. 2. In some embodiments, operations in addition to those depicted in FIG. 2 are performed before, between, during, and/or after the operations depicted in FIG. 2.

In some embodiments, one or more of the operations of ODP method 200 are a subset of operations of a method of determining vehicle position. In various embodiments, one or more of the operations of ODP method 200 are performed by using one or more processors, e.g., a processing circuitry 502 discussed below with respect to positioning processing circuitry 502 and FIG. 5. In some embodiments, ODP method 200 is executed on VOBC 101 and/or CBTC 103.

In some embodiments, an architecture and sensor data collection methods are combined and process sensor data to arrive at a high-integrity estimation of a vehicle constrained state. ODP method 200 is a VPS method to localize a vehicle, such as vehicle 102, a guided shuttle, monorail, or personal transport that is operating on a constrained path, such as track 104. In some embodiments, ODP method 200 provides an estimate of the vehicle constrained state. In some embodiments, ODP method 200 obtains data from specific sensors and determines a position, speed and acceleration estimate based on a prediction operation for the vehicle.

In some embodiments, operation 202 of ODP method 200, obtains vehicle ground speed (e.g., a speed measurement) from a ground speed sensor (e.g., tachometer) or vehicle speed is obtained (e.g., after processing) from a vision or scene sensor 110 (e.g., radar, camera, or the like). In some embodiments, all speed measurements are subject to an expected uncertainty and referred to as speed measurement uncertainty. Speed measurement uncertainty is accounted for in correction operation 206. Correction operation 206 is based on the measurements and the measurements variability/distribution which represents the measurement error/uncertainty. Uncertainty is accounted for through accounting for the causes of the speed measurement uncertainty (e.g., bias error, scaling error, sampling limitations, and the like. Uncertainty is due to limitations of the sensing technology, installation error, limitations of the estimation algorithms, and the like.

ODP method 200 moves from ground speed operation 202 to prediction operation 204 where a positioning prediction is formulated as a motion/process model that integrates the vehicle speed measurements received. In some embodiments, prediction operation 204 is implemented with an extended Kalman filter (EKF) (in estimation theory EKF is the nonlinear version of the Kalman filter that linearizes about an estimate of the current mean and covariance), batch estimation (based on a maximum a posteriori estimation approach where the time history of the input and output measurements are used as a single batch of data for estimating the finite element model parameters), or sliding window Bayesian framework (Bayesian networks are for taking an event that occurred and predicting the likelihood that any one of several possible known causes was the contributing factor). Positioning operation 204 isolates the path constraint (e.g., removes the path constraint from the prediction operation 204) and eliminates some inertial measurements (e.g., measurements such as the vehicle body bouncing) until correction operation 206. An output of prediction operation 204 is a predicted vehicle state, along a path constraint (e.g., track 104) using odometry (e.g., ground speed from sensors 106 and/or 110).

The process flow of ODP method 200 proceeds from prediction operation 204 to correction operation 206. In some embodiments, correction operation 206 is a measurement/observation model that uses a Kalman framework (a Kalman filter is an algorithm that uses a series of measurements observed over time, containing statistical noise and other inaccuracies, and produces estimates of unknown variables that tend to be more accurate than those based on a single measurement alone to update the predicted vehicle state). Additionally or alternatively, either a recursive (further known as a Bayes filter, a general probabilistic approach for estimating an unknown probability density function recursively over time using incoming measurements and a mathematical process model), a batch, or a sliding window implementation is used to allow more time-operations in the processing (e.g., leverage the track geometry information).

At operation 206, the predicted vehicle state is corrected using vehicle body inertial measurements 208 (e.g., accelerations and gyroscopic rates, inertial measurements). In some embodiments, the vehicle body inertial measurements 208 are provided directly by an inertial measurement device, such as IMU 108.

Additionally or alternatively, correction operation 206 is configured to use landmark measurements 210, determined from vision or scene sensor 110 (e.g., radar, camera, or the like). In some embodiments, correction operation 206 is configured to use ultra-wideband (UWB) radio or other landmark/anchor technology when the vehicle is within a region of localization (e.g., the region around a UWB anchor, or the region in which a global navigation satellite system (GNSS) signal is available), but where successive regions of localization are separated by significant distances.

In some embodiments, correction operation 206 is configured to use other optional measurements 212, such as radio frequency identification (RFID) tags located along track 104. In some embodiments, each of the inertial 208, landmark 210 and/or other measurements 212 are subject to an expected and characterizable uncertainty herein referred to as inertial measurement uncertainty. The inertial measurement uncertainty is due to vehicle body inertial measurements 208 that contain contributions from both the bogie kinematics and resulting dynamics, as well as the vehicle body dynamics due to the bogie-body suspension. Thus, inertial measurements 208 contain both inertial forces due to the vehicle motion and the inertial forces due to the vehicle vibrations and suspended/sprung mass of the vehicle body. The vehicle vibrations and suspended/sprung mass of the vehicle body create the inertial measurement uncertainty. Inertial measurement uncertainty is dealt with in correction operation 206. In correction operation 206 a prediction from prediction operation 204 and the prediction uncertainty are compared against the inertial measurement and the inertial measurement uncertainty to determine whether the comparisons match or not and what level of trust or weight should be given to the prediction and inertial measurement. In some embodiments, machine learning or artificial intelligence are configured to determine the weight assigned to the prediction and to the inertial measurement. The inertial measurement uncertainty is the result of bias, scaling factors, installation error, sampling limitations, and the like. In some embodiments, ODP method 200 is based on along track positioning, speed, and the associated uncertainties. In some embodiments, positioning and speed accuracies are affected by the quality and trust level in the along track position and speed uncertainties. In some embodiments, the uncertainty ranges from 5 cm to 10 m. This is an improvement over other approaches where the range of uncertainty is between 5 m to 25 m. The uncertainty is resolved in correction operation 206 where the predicted position is compared with dead reckoning position from inertial measurements 208, landmark measurements 210, and/or path constraint information that include inertial landmarks 214. In some embodiments, when the difference between the predicted location and the dead reckoning position of inertial measurements, landmark measurements, and/or inertial measurements are within the current uncertainty range, then a position correction is made at operation 206.

In some embodiments, correction operation 206 receives from database 214 a parametrization of the three-dimensional (3D) vehicle path, such as track 104, along which the vehicle is constrained. In some embodiments, the vehicle path is in the form of a parametrized curve, such that, at any point along the path constraint, it is possible to predict the expected inertial measurements when the vehicle position, velocity, and acceleration are known.

In some embodiments, the path constraint further contains one or more regions along the path during transit of which the vehicle experiences specific and characterizable inertial behavior (e.g., inertial landmarks). In some embodiments, switches, level crossings, speed bumps, road, or bridge transitions, or the like create inertial landmarks (e.g., the inertial forces due to the vehicle vibrations and suspended/sprung mass of the vehicle body). Additionally or alternatively, with inertial landmarks the inertial behavior of the vehicle is characterized. In some embodiments, the expected uncertainty in the inertial behavior, referred to as landmark inertial uncertainty, as well as the uncertainty in the placement of the landmark, referred to as landmark location uncertainty, is known. In some embodiments, inertial landmarks determine an acceleration (e.g., specific force) and angular rate signature for a specific geographical location. In some embodiments, inertial landmarks assist in correction operation 206 to correct inaccuracies in speed. In some embodiments, landmark range uncertainty ranges are between 10 cm to 1 m.

In some embodiments, correction operation 206 is configured to receive from database 214 path constraint information, precomputed observations, inertial landmarks, as well as other landmark information. ODP method 200 is configured to use inertial measurements 208 that are partially precomputed given a known path constraint during correction operation 206. Additionally or alternatively, this precomputation allows the vehicle state (position) to be corrected during correction operation 206 based on the geometry of the path constraint. In some embodiments, ODP method 200 reduces data dropout through correction operation 206 that is configured to increase position availability. Further, precomputed inertial observations along the path constraint stored in database 214 minimize the processing load during correction operation 206. In some embodiments, inertial landmarks are embedded in the precomputed information and stored in database 214. In this way, expected inertial observations (e.g., accelerations, gyroscopic rates, gravitational vector components, etc.) are precomputed at each location and parameterized according to the vehicle speed, along the path constraint. ODP method 200 reduces or is less susceptible to data dropout. Other approaches configured with IMU inputs to prediction operation 204 encounter periods of time where speed data is dropped; hence, the term data dropout. Data dropout occurs when a vehicle is moving slower than an IMU is able to detect or other situations where speed inputs to prediction operation are lost.

Correction operation 206 outputs a final vehicle state. The final vehicle state is inputted into single-chain fault detection and isolation operation 216. In some embodiments, an algorithm or method is used to achieve fault detection and isolation (FDI). In some embodiments, the fault detection and isolation is configured to use a receiver autonomous integrity monitoring (RAIM) like probabilistic model (that detects faults with redundant measurements), or a heuristic based (strategies derived from previous experiences with similar problems), or a probabilistic graphical model (a probabilistic model for which a graph expresses the conditional dependence structure between random variables), or a neural network (artificial networks used for predictive modeling, adaptive control and applications where they are trained via a dataset), or the like. In some embodiments, each input has an expected error and a fault condition that is derived. In some embodiments, these faults are detected and isolated in operation 216. In some embodiments, a recursive filter implementation is used. The error and fault condition are an inconsistency between the prediction and the inertial measurement. The error and fault condition is derived by determining whether the inconsistency is attributed to the prediction or the inertial measurement. Once determined, the fault is isolated to the prediction (e.g., odometry) or the measurement (e.g., inertial navigation).

ODP method 200 estimates a vehicle state that uses a 2-operation approach (i.e., prediction operation 204 and correction operation 206), where the prediction operation 204 is performed using ground speed. In some embodiments, correction operation 206 is performed using inertial measurements in comparison with a path constraint. In some embodiments, ODP method 200 further uses inertial landmarks (although other landmarks and measurements are optionally used) in addition to the inertial measurements.

ODP method 200 determines a vehicle state with minimal or nonexistent wayside, trackbed or path-installed infrastructure dedicated for positioning. In some embodiments, inertial landmarks are part of the existing trackbed, or path and no additional equipment is needed (leading to no installation cost). In some embodiments, when other landmarks are used (e.g., UWB, tags) then the spacing is increased to minimize the total number of installed landmarks (leading to a reduction of installation cost).

In some embodiments, ODP method 200 supports diversity in the vehicle state estimation technologies. In some embodiments, both speed and inertial measurement devices are used. In some embodiments, ODP method 200 provides a more complete use of the geometry of the path constraint, providing higher accuracy in determining the vehicle state. In some embodiments, ODP method 200 uses the geometry of the path constraint to correct the vehicle state. In some embodiments, ODP method 200 supports batch or sliding window implementations whereby the full geometry of the path constraint is used, rather than the local geometry around the current vehicle state.

In some embodiments, a high integrity solution is obtained when compared to existing FDI approaches. In some embodiments, ODP method 200 provides a more transparent and direct uncertainty estimation that allows for specific faults to be identified, particularly in relation to the geometry of the path constraint. In some embodiments, using ground speed in prediction operation 204 and not using less-trusted inputs (e.g., IMU, landmarks, and path constraint) in the correction operation 206 allows for more effective FDI. The uncertainties (positional, speed measurement, inertial measurement, and landmark inertial) are minimized in the early stages of ODP method 200. In other approaches, where an IMU is used for the ground speed input to the prediction operation 204, the position error is non-linear (e.g., squared) with respect to time ($t^2$). In other approaches, the more time a system relies on dead reckoning the larger the error. In some embodiments, when using odometry measurements, in contrast to IMU based speed measurements, the position error grows linearly with time. Thus, reducing error growth over time.

In some embodiments, ODP method 200 provides for a more efficient prediction operation 204 and correction operation 206 and higher performance and availability than other approaches. In some embodiments, ODP method 200 allows longer running times before positional uncertainty is breached which leads to higher availability than other methods. In some embodiments, ODP method 200 allows for longer running times without correction operation 206 which leads to increased availability over other methods.

In some embodiments, ODP method 200 provides for lower installation and maintenance costs compared to other approaches. In some embodiments, ODP method 200 achieves improved performance with fewer wayside, trackbed or path-installed landmarks, resulting in lower installation cost and maintenance cost compared to other approaches.

In some embodiments, ODP method 200 is configured to use an along-track acceleration input to prediction operation 204 (along with odometry). Along-track acceleration does not contain track geometry information. Instead, along-track acceleration provides an accurate along-track estimate of position when combined with along-track speed from odometry.

In some embodiments, inertial measurements 208 are used in prediction operation 204 along with odometry measurements 202. While the along-track acceleration from the inertial measurements 208 contains no information of track geometry, the along-track acceleration from the inertial measurements 208 produces an accurate along-track estimate of position when combined with odometry measurements 202. In some embodiments, along-track acceleration in combination with odometry measurements 202 is a better estimate of along-track speed. In some embodiments, X-axis, Y-axis, and Z-axis acceleration are used to derive along-track acceleration, and X-axis gyroscope measurements are used to estimate vehicle roll and pitch and produce a contribution of X-axis, Y-axis, and Z-axis acceleration components. In some embodiments, an X-axis gyroscope output is fed into prediction to estimate roll and pitch states. The roll state is a coupling of gravity with lateral acceleration (e.g., tangential acceleration is composed of both x and y components due to misalignment between the bogie and vehicle body frame). In some embodiments, roll state estimation determines a contribution of X-axis and Y-axis components, thus producing an accurate tangential acceleration. In some embodiments, the roll state estimation is configured to be performed with X-axis and Y-axis gyroscopes.

In some embodiments, ground speed is determined via the processing of a subset of inertial measurements 208 instead of a ground speed measurement sensor. In some embodiments, inertial measurements 208 or a subset of inertial measurements 208 produce effective ground speed measurements including tangential speed.

In some embodiments, ODP method 200 uses both speed and inertial measurement devices for prediction operation 204. In some embodiments, path constraint information from database 214 supply the geometry of the path constraint. In some embodiments, ODP method 200 is configured to use the path constraint geometry to correct the predicted vehicle state. Additionally or alternatively, ODP method 200 supports batch or sliding window implementations where the full geometry of the path constraint is used, rather than the local geometry around the current vehicle state. In some embodiments, the path constraint is correcting the predicted vehicle state In some embodiments, ODP method 200, is more accurate when compared to other FDI approaches. In some embodiments, uncertainty estimation allows for specific faults (e.g., speed measurement uncertainty and inertial measurement uncertainty) to be identified, particularly in relation to the geometry of the path constraint. In some embodiments, the use of ground speed (e.g., trusted and characterized) in the prediction operation, and less-trusted inputs (e.g., IMU, landmarks, path constraint) in the correction operation allow for effective FDI.

In some embodiments, ODP method 200 provides higher performance and availability when compared with other CBTC approaches. Additionally or alternatively, ODP method 200 allows for longer running times before positional uncertainty is breached, leading to availability of an accurate vehicle position. In some embodiments, ODP method 200 allows for increased running times without correction operation 206.

Figure 3:
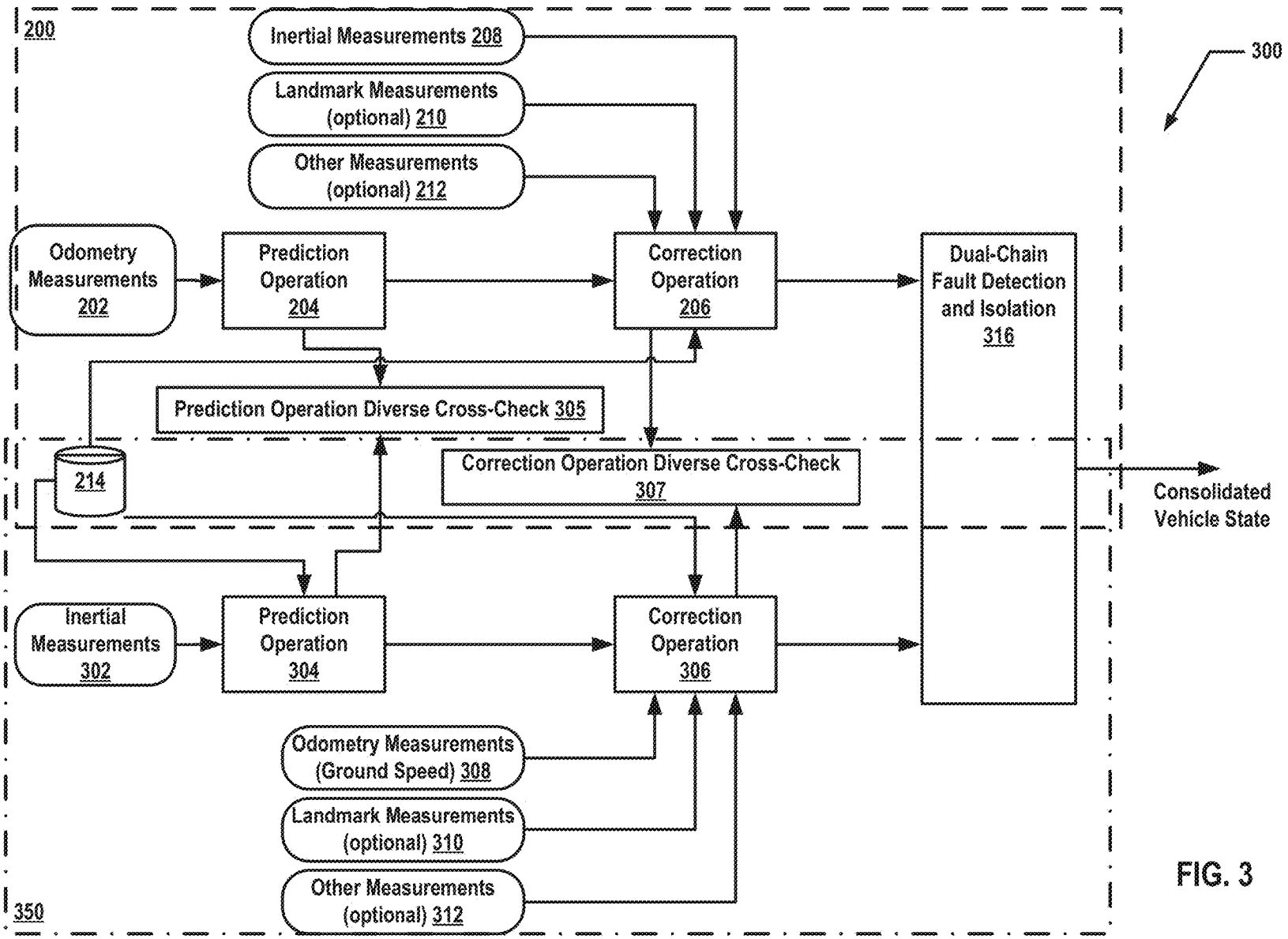
FIG. 3 is a high-level process flow diagram of a dual chain architecture (DCA), in accordance with some embodiments.

FIG. 3 is a high-level process flow diagram of a dual chain architecture (DCA) method 300, in accordance with some embodiments.

In some embodiments, DCA method 300 is a subsystem of VPS 100 like ODP method 200 and is used on vehicle 102 to accurately predict positioning, motion, and velocity. In some embodiments, DCA method 300 is used to determine vehicle positioning for vehicle 102 of VPS 100. The sequence in which the operations of DCA method 300 occur are like the operations of ODP method 200 depicted in FIG. 2 and similar operations retain the same reference numbers for the sake of brevity and is for illustration only. The operations of DCA method 300 are capable of being executed in sequences that differ from that depicted in FIG. 3. In some embodiments, operations in addition to those depicted in FIG. 3 are performed before, between, during, and/or after the operations depicted in FIG. 3.

Figure 5:
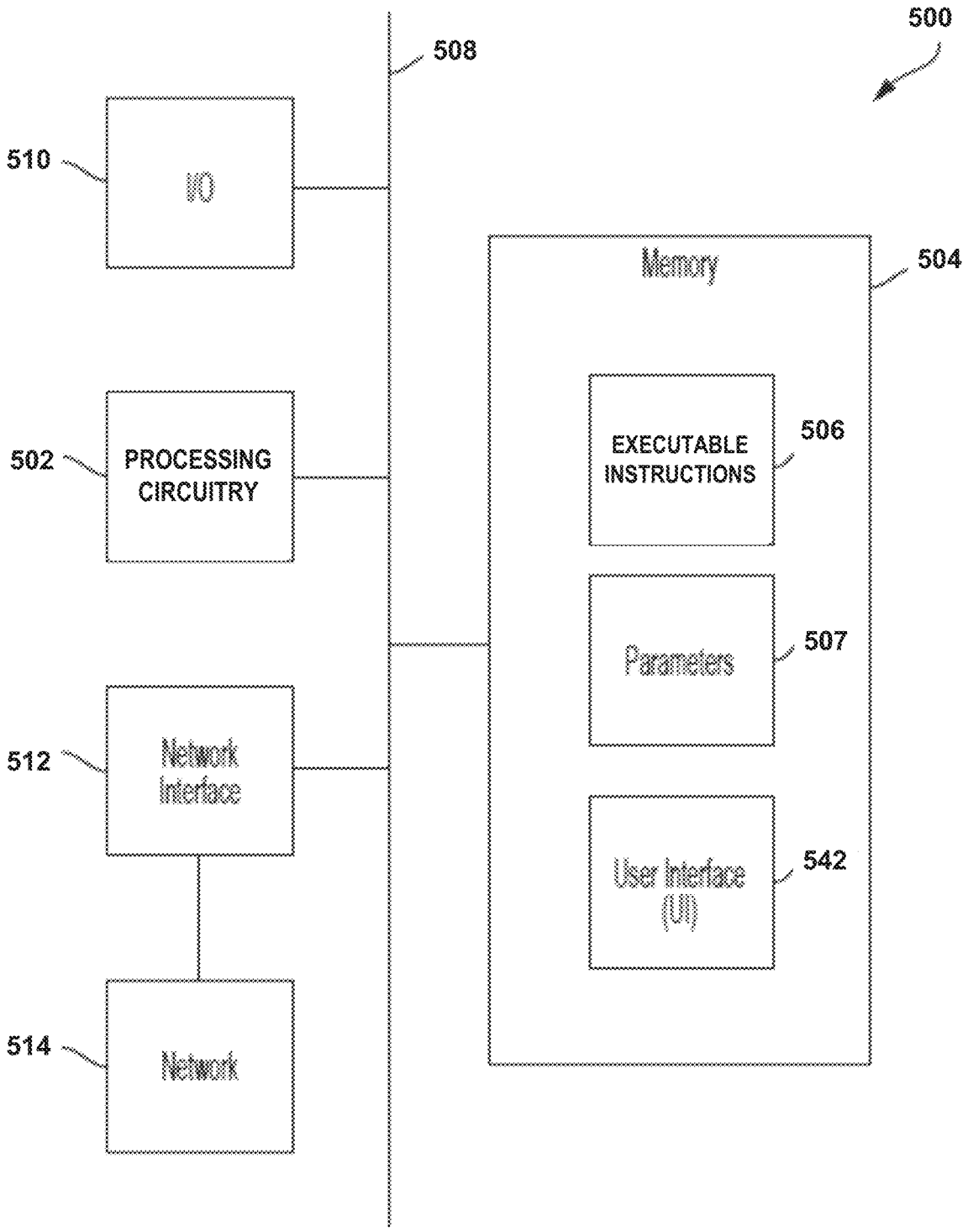
FIG. 5 is a high-level functional block diagram of a processor-based system, in accordance with some embodiments.

In some embodiments, one or more of the operations of DCA method 300 are a subset of operations of a method of determining vehicle position. In various embodiments, one or more of the operations of DCA method 300 are performed by using one or more processors, e.g., a processing circuitry 502 discussed below with respect to positioning processing circuitry 502 (FIG. 5). In some embodiments, DCA method 300 is executed on VOBC 101 and/or CBTC 103.

DCA method 300 combines dual complementary processing chains (e.g., ODP 200 and IMU driven positioning (IMUDP) 350) that each compute the vehicle constrained state, in such a way that diverse supervision and cross-checking is possible throughout the entire processing chain.

Operation 302 of DCA method 300, receives inertial measurements from an IMU, such as IMU 108. In some embodiments, method 300 progresses to operation 304 where a prediction operation is performed using path constraint information from database 214. Additionally or alternatively, when using unconstrained integration of inertial measurements (e.g., a free-space integration of inertial measurement units (IMU) or inertial sensors) in order to perform positioning, a vehicle is restricted along a track. Thus, the path constraint information is used at predication operation 304. This restriction; however, introduces error and/or uncertainty in the vehicle position.

DCA method 300 progresses to prediction operation diverse cross-check 305 where a vehicle predicted state from prediction operation 204 and prediction operation 304 are compared. DCA method 300 determines which of the vehicle predicted states, either the vehicle predicted state of prediction operation 204 or prediction operation 304 is more accurate. In some embodiments, based on the accuracy determination, DCA method 300 will use the more accurate of the predicted vehicle state from either ODP method 200 or IMUDP 350. In some embodiments, a position is determined using odometry prediction and IMU correction at correction operation 206. In some embodiments, position is determined using IMU prediction and odometry correction at correction 306. In some embodiments, the position of correction operation 206 is compared with the position of correction operation 306 and an accuracy is determined based upon the comparison.

ODP method 300 moves from prediction operation 304, to correction operation 306. Correction operation 306 is a measurement/observation model that uses a Kalman framework to update the predicted vehicle state. Additionally or alternatively, either a recursive, a batch, or a sliding window implementation is used to allow more time-operations in the processing.

At correction operation 306 the vehicle state corrected using vehicle odometry measurements 308 (e.g., ground speed). In some embodiments, the vehicle ground speed measurements 308 are supplied directly by a ground speed device (e.g., speed sensor 106).

In some embodiments, correction operation 306 is configured to use landmark measurements 310, determined from vision or scene sensor 110 (e.g., radar, camera, or the like). In some embodiments, correction operation 306 is configured to use of ultra-wideband (UWB) radio or other landmark/anchor technology when the vehicle is within a region of localization (e.g., the region around a UWB anchor, or the region in which a global navigation satellite system (GNSS) signal is available), but where successive regions of localization are separated by significant distances.

In some embodiments, correction operation 306 is configured to use other optional measurements 312, such as radio frequency identification (RFID) tags located along track 104. In some embodiments, each of the ground speed 308, landmark 310 and/or other measurements 312 are subject to an expected and characterizable uncertainty referred to above as speed measurement uncertainty.

In some embodiments, correction operation 306 receives from database 214 a parametrization of the three-dimensional (3D) vehicle path, such as track 104, along which the vehicle is constrained. In some embodiments, the vehicle path is in the form of a parametrized curve, such that, at any point along the path constraint, it is possible to predict the expected inertial measurements when the vehicle position, velocity, and acceleration are known.

In some embodiments, the path constraint further contains one or more regions along the path during transit of which the vehicle experiences specific and characterizable inertial behavior (e.g., inertial landmarks). In some embodiments, switches, level crossings, speed bumps, road, or bridge transitions, or the like create inertial landmarks (e.g., the inertial forces due to the vehicle vibrations and suspended/sprung mass of the vehicle body). Additionally or alternatively, with inertial landmarks the inertial behavior of the vehicle is characterized. In some embodiments, the expected uncertainty in the inertial behavior, referred to as landmark inertial uncertainty, as well as the uncertainty in the placement of the landmark, referred to as landmark location uncertainty, is known.

In some embodiments, correction operation 306 is configured to receive from database 214 path constraint information, precomputed observations, inertial landmarks, as well as other landmark information. DCA method 300 is configured to use ground speed measurements 308 during correction operation 306 In some embodiments, DCA method 300 reduces data dropout through correction operation 306, that is configured to increase position availability. In some embodiments, precomputed inertial observations along the path constraint stored in database 214 minimize the processing load during correction operation 306. In some embodiments, inertial landmarks are embedded in the precomputed information and stored in database 214. In this way, expected inertial observations (e.g., accelerations, gyroscopic rates, gravitational vector components, etc.) are precomputed at each location and parameterized according to the vehicle speed, along the path constraint.

Correction operation 306 outputs a final vehicle state. Final vehicle states from correction operation 206 and correction operation 306 are compared at correction operation divers cross check operation 307. In some embodiments, like the operation at prediction operation diverse cross-check 305, DCA method 300 determines which final vehicle state is most accurate. Additionally or alternatively, based on the determination of which final vehicle state is more reliable, DCA method 300 will use either ODP method 200 or IMUDP method 350. In some embodiments, DCA method 300 is configured to use a statistical based filter, such as a Kalman filter, to determine a state update (i.e., correction). In some embodiments, the state update is typically made using multiple measurements. In some embodiments, each measurement has an average ($\mu$) and standard deviation ($\sigma$). In a non-limiting example, assuming that all measurements are identical ($\mu 1=\mu 2= \ldots =\mu n$) and the standard deviation of all measurements are identical ($\sigma 1=\sigma 2= \ldots = \sigma n$). Then the output is $\mu=(\mu 1+\mu 2+ \ldots +\mu n)/n=\mu 1=\mu 2=\mu n$, and $\sigma=((\sigma 12+\sigma 22+ \ldots +\sigma n2)/n2)^{1/2}=\sigma 1/n1/=\sigma 2/n^{1/2}= \ldots = \sigma n/n^{1/2}<\sigma 1=\sigma 2= \ldots =\sigma n$.

Fault detection and isolation is performed by method 350 at operation 316. In some embodiments, DCA method 300 performs diversity checking at prediction operations cross-check 305 and correction operations cross-check 307. Additionally or alternatively, dual-chain FDI operation 316 models simultaneous faults in both chains (ODP method 200 and IMUDP 350).

In some embodiments, DCA method 300 provides algorithmic and sensor diversity. Additionally or alternatively, dual chains (e.g., ODP 200 and IMUDP 350) are complementary of each other in that each calculates positioning information, but with different sensors (e.g., a ground sensor for ODP 200 and an IMU for IMUDP 350), and in parallel operations (i.e., prediction operations 204 & 304 and correction operations 206 & 306).

Figure 4:
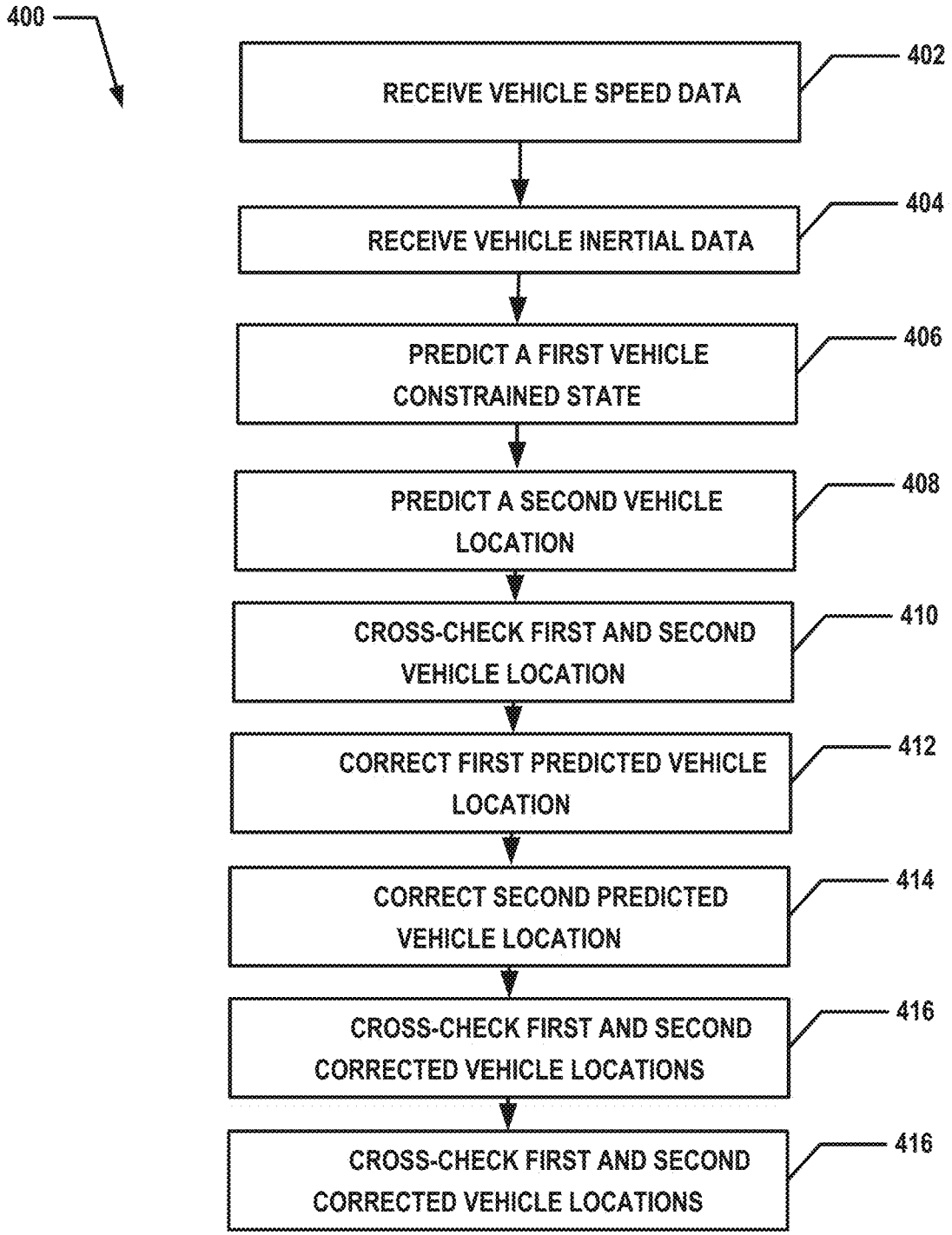
FIG. 4 is a high-level flow diagram of a DCA method, in accordance with some embodiments.

FIG. 4 is a high-level flow diagram of a DCA method 400, in accordance with some embodiments.

In some embodiments, DCA method 400 is a subsystem of VPS 100 like ODP method 200 and DCA method 300 and is used on vehicle 102 to accurately predict positioning, motion, and velocity. In some embodiments, DCA method 400 is used to determine vehicle positioning for vehicle 102 of VPS 100. The sequence in which the operations of DCA method 400 occur are like the operations of ODP method 200 and DCA method 300 depicted in FIGS. 2 and 3 and is for illustration only. The operations of DCA method 400 are capable of being executed in sequences that differ from that depicted in FIG. 4. In some embodiments, operations in addition to those depicted in FIG. 4 are performed before, between, during, and/or after the operations depicted in FIG. 4.

In some embodiments, one or more of the operations of DCA method 400 are a subset of operations of a method of determining vehicle position. In various embodiments, one or more of the operations of DCA method 400 are performed by using one or more processors, e.g., a processing circuitry 502 discussed below with respect to positioning processing circuitry 502 (FIG. 5). In some embodiments, DCA method 400 is executed on VOBC 101 and/or CBTC 103.

FIG. 4 includes processing blocks 402, 404, 406, 408, 410, 412, 414, 416 and 418. At block 402, vehicle speed or odometry data is received. As a non-limiting example, in the embodiments as shown in FIGS. 1, 2, and 3, ground speed is obtained from a ground speed sensor, such as speed sensor 106 at operation 202. From block 402, the flow proceeds to block 404.

At block 404, vehicle inertial data is received. As a non-limiting example, in the embodiments as shown in FIGS. 1, 2, and 3 inertial measurements are obtained from a sensor, such as IMU 110 at operation 208 and 302. From block 404, the flow proceeds to block 406.

At block 406, a first constrained vehicle state is predicted. As a non-limiting example, in the embodiments as shown in FIGS. 1, 2, and 3 processor 502 determines a first predicted constrained vehicle state at operation 206. From block 406, the flow proceeds to block 408.

At block 408, a second constrained vehicle state is predicted. As a non-limiting example, in the embodiments as shown in FIG. 3 processor 502 determines a second predicted constrained vehicle state at operation 306. From block 408, the flow proceeds to block 410.

At block 410, the first and second predicted constrained vehicle states are cross-checked. As a non-limiting example, in the embodiments as shown in FIG. 3 processor 502 determines whether one predicted vehicle state is more reliable than the other at operation 305. From block 410, the flow proceeds to block 412. Before determining the accuracy processor 502 determines what state (e.g., predicted or measured) is more reliable or trusted. The answer to this question will determine the weight (e.g., trust) assigned to each in order to produce a state update based on the prediction and measurements. The accuracy is secondary and is resolved by the statistical nature of the filter.

At block 412, the first predicted constrained vehicle state is corrected based upon data other than ground speed. In some embodiments, a correction is not performed as the first predicted vehicle state is accurate. As a non-limiting example, in the embodiments as shown in FIGS. 1, 2, and 3 inertial data, inertial landmarks, path constraint information, visual landmarks and other data is used to create a corrected constrained vehicle operation 206. From block 412, the flow proceeds to block 414.

At block 414, the second predicted constrained vehicle state is corrected. In some embodiments, a correction is not performed as the second predicted vehicle state is accurate. As a non-limiting example, in the embodiments as shown in FIG. 3 ground speed data, inertial landmarks, path constraint information, visual landmarks and other data is used to create a corrected constrained vehicle operation 306. From block 414, the flow proceeds to block 416.

At block 416, the first and second corrected constrained vehicle states are cross-checked. As a non-limiting example, in the embodiments as shown in FIG. 3 processor 502 determines whether one corrected vehicle state is more reliable than the other at operation 307. From block 416, the flow proceeds to block 418.

At block 418, after a determination as to the first and second corrected vehicle states, a final vehicle position state is determined. In a non-limiting example, a fault-corrected vehicle state is determined as shown in FIG. 2 or a consolidated vehicle state is determined as shown in FIG. 3. In some embodiments, the fault-corrected vehicle state or consolidated vehicle state is outputted to a user interface, such as user interface 542 (FIG. 5). In some embodiments, the fault-corrected vehicle state or consolidated vehicle state is outputted to CBTC 103 (FIG. 1). In some embodiments, in the event the first and second corrected vehicle states do not cross-check correctly a dead-reckoning solution is used until the next the fault-corrected vehicle state or consolidated vehicle state is determined.

FIG. 5 is a high-level functional block diagram of a processor-based system, in accordance with some embodiments. In some embodiments, positioning processing circuitry 500 is a general-purpose computing device including a hardware processor 502 and a non-transitory, computer-readable storage medium 504. In some embodiments, positioning processing circuity 500 is VOBC 101 and/or CBTC 103. Storage medium 504, amongst other things, is encoded with, i.e., stores, computer program instructions 506, i.e., a set of executable instructions such as ODP method 200, and/or DCA methods 300 and 400 of FIGS. 2, 3, and 4. Execution of instructions 506 by hardware processor 502 represents (at least in part) an ODP and/or DCA tool which implements a portion or all of the methods described herein in accordance with one or more embodiments (hereinafter, the noted processes and/or methods).

Processor 502 is electrically coupled to a computer-readable storage medium 504 via a bus 508. Processor 502 is further electrically coupled to an I/O interface 510 by bus 508. A network interface 512 is further electrically connected to processor 502 via bus 508. Network interface 512 is connected to a network 514, so that processor 502 and computer-readable storage medium 504 are capable of connecting to external elements via network 514. Processor 502 is configured to execute computer program instructions 506 encoded in computer-readable storage medium 504 to cause positioning processing circuitry 500 to be usable for performing a portion or all of the noted processes and/or methods. In one or more embodiments, processor 502 is a central processing unit (CPU), a multi-processor, a distributed processing system, an application specific integrated circuit (ASIC), and/or a suitable processing unit.

In one or more embodiments, computer-readable storage medium 504 is an electronic, magnetic, optical, electromagnetic, infrared, and/or a semiconductor system (or apparatus or device). For example, computer-readable storage medium 504 includes a semiconductor or solid-state memory, a magnetic tape, a removable computer diskette, a random-access memory (RAM), a read-only memory (ROM), a rigid magnetic disk, and/or an optical disk. In one or more embodiments using optical disks, computer-readable storage medium 504 includes a compact disk-read only memory (CD-ROM), a compact disk-read/write (CD-R/W), and/or a digital video disc (DVD).

In one or more embodiments, storage medium 504 stores computer program instructions 506 configured to cause positioning processing circuitry 500 to be usable for performing a portion or all the noted processes and/or methods. In one or more embodiments, storage medium 504 further stores information, such as ODP method 200 or DCA methods 300 and/or 400 of FIGS. 2, 3, and 4 which facilitates performing a portion or all of the noted processes and/or methods. In one or more embodiments, storage medium 504 stores parameters 507.

Positioning processing circuitry 500 includes I/O interface 510. I/O interface 510 is coupled to external circuitry. In one or more embodiments, I/O interface 510 includes a keyboard, keypad, mouse, trackball, trackpad, touchscreen, and/or cursor direction keys for communicating information and commands to processor 502.

Positioning processing circuitry 500 further includes network interface 512 coupled to processor 502. Network interface 512 allows positioning processing circuitry 500 to communicate with network 514, to which one or more other computer systems are connected. Network interface 512 includes wireless network interfaces such as BLUETOOTH, WIFI, LTE 5G, WIMAX, GPRS, or WCDMA; or wired network interfaces such as ETHERNET, USB, or IEEE-864. In one or more embodiments, a portion or all of noted processes and/or methods, is implemented in two or more positioning processing circuitries 500.

Positioning processing circuitry 500 is configured to receive information through I/O interface 510. The information received through I/O interface 510 includes one or more of instructions, data, design rules, and/or other parameters for processing by processor 502. The information is transferred to processor 502 via bus 508. Positioning processing circuitry 500 is configured to receive information related to a UI through I/O interface 510. The information is stored in computer-readable medium 504 as user interface (UI) 542.

In some embodiments, a portion or all the noted processes and/or methods is implemented as a standalone software application for execution by a processor. In some embodiments, a portion or all the noted processes and/or methods is implemented as a software application that is a part of an additional software application. In some embodiments, a portion or all the noted processes and/or methods is implemented as a plug-in to a software application.

In some embodiments, the processes are realized as functions of a program stored in a non-transitory computer readable recording medium. Examples of a non-transitory computer-readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

A system of one or more computers are configured to perform particular operations or actions by virtue of having software, firmware, hardware, or a combination of them installed on the system that in operation causes or cause the system to perform the actions. One or more computer programs are configured to perform particular operations or actions by virtue of including instructions that, when executed by data processing circuitry, cause the apparatus to perform the actions. In some embodiments, a vehicle positioning system includes processing circuitry in communication with the vehicle. The system further includes a memory connected to the processing circuitry, where the memory is configured to store executable instructions that, when executed by the processing circuitry, facilitate performance of operations. The operations include to receive vehicle-speed data from a first set of sensors operably coupled to the vehicle. The operations further include to predict a vehicle location based on the vehicle-speed data. The operations further include to receive inertial data from a second set of sensors operably coupled to the vehicle, and update the predicted vehicle location based upon the inertial data. Other embodiments of this aspect include corresponding computer systems, apparatus, and computer programs recorded on one or more computer storage devices, each configured to perform the actions of the methods.

Implementations may include one or more of the following features. The system where the performance of operations further includes to update the predicted vehicle location based on a vehicle path constraint stored in the memory, where the vehicle is restricted to travel on a parameterized three-dimensional (3D) vehicle path. The performance of operations further includes to update the predicted vehicle location based on a priori inertial landmarks along a vehicle path constraint and stored in the memory. The performance of operations further includes to update the predicted vehicle location based on other landmarks detected by a third set of sensors operably coupled to the vehicle and the a priori inertial landmarks along the vehicle path constraint and stored in the memory. The performance of operations further includes detection and isolation of fault conditions within one of the inertial data, the vehicle path constraint, the a priori inertial landmarks, and the other landmarks. The performance of operations further includes to output a fault-updated vehicle location based on the fault conditions. The performance of operations further includes to predict the vehicle location based on the inertial data and the vehicle speed data. Implementations of the described techniques may include hardware, a method or process, or computer software on a computer-accessible medium.

In some embodiments, a non-transitory computer-readable storage medium includes executable instructions that, when executed by a processor, facilitate performance of operations. The operations include receiving vehicle-speed data from a first set of sensors operably coupled to a vehicle. The operations further includes predicting a first-chain vehicle location based on the vehicle speed data. The operations further includes receiving inertial data from a second set of sensors operably coupled to the vehicle. The operations further includes updating the predicted first-chain vehicle location based upon the inertial data. Other embodiments of this aspect include corresponding computer systems, apparatus, and computer programs recorded on one or more computer storage devices, each configured to perform the actions of the methods.

Implementations may include one or more of the following features. The storage medium where the performance of operations further includes receiving the inertial data from the second set of sensors operably coupled to the vehicle. The operations further includes predicting a second-chain vehicle location based on the inertial data. The operations further includes receiving the vehicle speed data from the first set of sensors operably coupled to the vehicle, and updating the predicted second-chain vehicle location based upon the vehicle speed data. The performance of operations further includes cross-checking the predicted first-chain vehicle location against the predicted second-chain vehicle location. The performance of operations further includes determining whether one or more of the predicted first-chain vehicle location and the predicted second-chain vehicle location are unusable based upon the cross-check of the predicted first-chain vehicle location against the predicted second-chain vehicle location. The performance of operations further includes cross-checking the updated first-chain vehicle location against the updated second-chain vehicle location. The performance of operations further includes determining whether one or more of the updated first-chain vehicle location and the updated second-chain vehicle location are unusable based upon the cross-check of the updated first-chain vehicle location against the updated second-chain vehicle location. The performance of operations further includes updating the updated first-chain vehicle location and the updated second-chain vehicle location based on detected faults in one of the first set of sensors and the second set of sensors. Implementations of the described techniques may include hardware, a method or process, or computer software on a computer-accessible medium.

In some embodiments, a method of positioning a vehicle includes receiving vehicle speed data from a first set of sensors operably coupled to a vehicle. The method further includes receiving vehicle inertial data from a second set of sensors operably coupled to the vehicle. The method further includes predicting a first vehicle location with processing circuitry and based on the vehicle speed data. The method further includes predicting a second vehicle location with the processing circuitry and based on the vehicle inertial data. The method further includes cross-checking the first predicted vehicle location against the second predicted vehicle location. The method further includes determining whether one of the predicted first vehicle location and the predicted second vehicle location is unreliable based upon the cross-checking. Other embodiments of this aspect include corresponding computer systems, apparatus, and computer programs recorded on one or more computer storage devices, each configured to perform the actions of the methods.

Implementations may include one or more of the following features. The method includes updating the predicted first vehicle location based upon the vehicle inertial data. The method further includes updating the predicted second vehicle location based upon the vehicle speed data and cross-checking the first updated vehicle location against the second updated vehicle location. The method includes determining whether one or more of the updated first vehicle location and the updated second vehicle location is unreliable based upon the cross-check of the updated first vehicle location against the updated second vehicle location. The method includes updating one or more of the predicted first vehicle location and the predicted second vehicle location based upon a constrained vehicle path that the vehicle is traveling. The method includes updating one or more of the predicted first vehicle location and the predicted second vehicle location based upon inertial landmarks stored in a memory. Implementations of the described techniques may include hardware, a method or process, or computer software on a computer-accessible medium.

The foregoing outlines features of several embodiments so that those skilled in the art better understand the aspects of the present disclosure. Those skilled in the art appreciate that they readily use the present disclosure as a basis for designing or updating other processes and structures for carrying out the same purposes and/or achieving the same advantages of the embodiments introduced herein. Those skilled in the art further realize that such equivalent constructions do not depart from the spirit and scope of the present disclosure, and that they make various changes, substitutions, and alterations herein without departing from the spirit and scope of the present disclosure.

What is claimed is:

1. A vehicle positioning system, the system comprising:

a vehicle on a guideway;

processing circuitry in communication with the vehicle; and a memory connected to the processing circuitry, wherein the memory is configured to store executable instructions that, when executed by the processing circuitry, facilitate performance of operations, comprising:

receive vehicle-speed data from a first set of sensors operably coupled to the vehicle;

predict a first-chain vehicle location based on the vehicle-speed data;

receive inertial data from a second set of sensors operably coupled to the vehicle;

update the predicted first-chain vehicle location based upon the inertial data;

predict a second-chain vehicle location based on the inertial data;

cross-check the predicted first-chain vehicle location against the predicted second-chain vehicle location, prior to updating the predicted first-chain vehicle location based upon the inertial data; and update the predicted second-chain vehicle location based upon the vehicle-speed data.

2. The system of claim 1 wherein the performance of operations further comprises:

update the predicted first and second-chain vehicle locations based on a vehicle path constraint stored in the memory, wherein the vehicle is restricted to travel on a parameterized three-dimensional (3D) vehicle path.

3. The system of claim 2 wherein the performance of operations further comprises:

update the predicted first and second-chain vehicle locations based on a priori inertial landmarks along a vehicle path constraint and stored in the memory.

4. The system of claim 3 wherein the performance of operations further comprises:

update the predicted first and second-chain vehicle locations based on other landmarks detected by a third set of sensors operably coupled to the vehicle and the a priori inertial landmarks along the vehicle path constraint and stored in the memory.

5. The system of claim 4 wherein the performance of operations further comprises:

detection and isolation of fault conditions within one of the inertial data, the vehicle path constraint, the a priori inertial landmarks, and the other landmarks.

6. The system of claim 5 wherein the performance of operations further comprises:

output a fault-updated vehicle location based on the fault conditions.

7. The system of claim 1 wherein the performance of operations further comprises:

cross-check the predicted first-chain vehicle location against the predicted second-chain vehicle location, prior to updating the predicted second-chain vehicle location based upon the vehicle-speed data.

8. A non-transitory computer-readable storage medium, comprising executable instructions that, when executed by a processor, facilitate performance of operations, comprising:

receiving vehicle-speed data from a first set of sensors operably coupled to a vehicle;

predicting a first-chain vehicle location based on the vehicle speed data;

receiving inertial data from a second set of sensors operably coupled to the vehicle;

updating the predicted first-chain vehicle location based upon the inertial data;

receiving the inertial data from the second set of sensors operably coupled to the vehicle;

predicting a second-chain vehicle location based on the inertial data; and assigning a first weight to the predicted first-chain vehicle location or a second weight to the second-chain vehicle location based on cross-checking the predicted first-chain vehicle location and the predicted second-chain vehicle location.

9. The storage medium of claim 8 wherein the performance of operations further comprises:

receiving the vehicle speed data from the first set of sensors operably coupled to the vehicle; and updating the predicted second-chain vehicle location based upon the vehicle speed data.

10. The storage medium of claim 9 wherein the performance of operations further comprises:

cross-checking the predicted first-chain vehicle location against the predicted second-chain vehicle location.

11. The storage medium of claim 10 wherein the performance of operations further comprises:

determining whether one or more of the predicted first-chain vehicle location and the predicted second-chain vehicle location are unusable based upon the cross-check of the predicted first-chain vehicle location against the predicted second-chain vehicle location.

12. The storage medium of claim 9 wherein the performance of operations further comprises:

cross-checking the updated first-chain vehicle location against the updated second-chain vehicle location.

13. The storage medium of claim 12 wherein the performance of operations further comprises:

determining whether one or more of the updated first-chain vehicle location and the updated second-chain vehicle location are unusable based upon the cross-check of the updated first-chain vehicle location against the updated second-chain vehicle location.

14. The storage medium of claim 9 wherein the performance of operations further comprises:

updating the updated first-chain vehicle location and the updated second-chain vehicle location based on detected faults in one of the first set of sensors and the second set of sensors.

15. A method of positioning a vehicle comprising:

receiving vehicle speed data from a first set of sensors operably coupled to a vehicle;

receiving vehicle inertial data from a second set of sensors operably coupled to the vehicle;

predicting a first vehicle location with processing circuitry and based on the vehicle speed data;

predicting a second vehicle location with the processing circuitry and based on the vehicle inertial data;

cross-checking the first predicted vehicle location against the second predicted vehicle location prior to updating the predicted first-chain vehicle location based upon the inertial data; and determining whether one of the predicted first vehicle location and the predicted second vehicle location is unreliable based upon the cross-checking.

16. The method of claim 15 further comprising, after cross-checking the first predicted vehicle location against the second predicted vehicle location:

updating the predicted first vehicle location based upon the vehicle inertial data;

updating the predicted second vehicle location based upon the vehicle speed data; and cross-checking the first updated vehicle location against the second updated vehicle location.

17. The method of claim 16 further comprising:

determining whether one or more of the updated first vehicle location and the updated second vehicle location is unreliable based upon the cross-check of the updated first vehicle location against the updated second vehicle location.

18. The method of claim 17 further comprising:

updating one or more of the predicted first vehicle location and the predicted second vehicle location based upon a constrained vehicle path that the vehicle is traveling.

19. The method of claim 17 further comprising:

updating one or more of the predicted first vehicle location and the predicted second vehicle location based upon inertial landmarks stored in a memory.

20. The method of claim 19 further comprising, updating one or more of the predicted first vehicle location and the predicted second vehicle location based upon other landmarks stored in the memory.

* * * * *